US008278923B2

(12) United States Patent
Samson et al.

(10) Patent No.: US 8,278,923 B2
(45) Date of Patent: Oct. 2, 2012

(54) DOWNHOLE ORIENTATION SENSING WITH NUCLEAR SPIN GYROSCOPE

(75) Inventors: Etienne M. Samson, Houston, TX (US); John L. Maida, Jr., Houston, TX (US); John Luscombe, Houston, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 384 days.

(21) Appl. No.: 12/792,558

(22) Filed: Jun. 2, 2010

(65) Prior Publication Data

US 2011/0298457 A1 Dec. 8, 2011

(51) Int. Cl.
*G01V 3/00* (2006.01)

(52) U.S. Cl. ..... 324/303; 324/300

(58) Field of Classification Search ..... 324/300–322; 166/255, 66

See application file for complete search history.

(56) References Cited

U.S. PATENT DOCUMENTS

| | | | | |
|---|---|---|---|---|
| 7,038,450 | B2 * | 5/2006 | Romalis et al. | 324/304 |
| 7,834,621 | B2 * | 11/2010 | Anderson | 324/300 |
| 2010/0219820 | A1 * | 9/2010 | Skidmore et al. | 324/247 |
| 2011/0297372 | A1 * | 12/2011 | Maida et al. | 166/255.2 |

OTHER PUBLICATIONS

Kornack, T.W. and Romalis, M.V.; Dynamics of Two Overlapping Spin Ensembles Interacting by Spin Exchange; 253002-1 to -4, vol. 89, No. 25; The American Physical Society; Dec. 16, 2002; 4 pages; Princeton, New Jersey.

Halliburton; Evader MWD Gyro Service; Article H03876; Dec. 2006; 2 pages.

Kornack, T.W., Ghosh R.K. and Romalis, M.V.; Nuclear-Spin Gyroscope Based on an Atomic Co-Magnetometer; Technical Support Package for LEW-17942-1; Nasa Tech Briefs; Jan. 1, 2008; 6 pages; Cleveland, Ohio.

Kominis, I.K., Kornack, T.W., Allred J.C. and Romalis, M.V.; A Subfemtotesla Multichannel Atomic Magnetometer; Article of vol. 422 pp. 596-599; Nature; Apr. 10, 2003; 2 pages; Princeton, New Jersey.

Torkildsen, T., Havardstein, S.T., Weston, J. L. and Ekseth, R.; Prediction of Wellbore Position Accuracy When Surveyed With Gyroscopic Tools; SPE 90408; Society of Petroleum Engineers; Sep. 26-29, 2004; 21 pages; Houston, Texas.

Torkildsen T., Havardstein S.T., Weston J. and Ekseth R.; Prediction of Wellbore Position Accuracy When Surveyed With Gyroscopic Tools; [Revised for publication in] SPE Drilling & Completion Magazine, [Peer reviewed article]; Mar. 2008; 8 pages; Houston, Texas.

* cited by examiner

*Primary Examiner* — Brij Shrivastav

(74) *Attorney, Agent, or Firm* — John W. Wustenberg; Smith IP Services, P.C.

(57) ABSTRACT

Downhole orientation sensing with a nuclear spin gyroscope. A downhole orientation sensing system for use in conjunction with a subterranean well can include a downhole instrument assembly positioned in the well, the instrument assembly including an atomic comagnetometer, and at least one optical waveguide which transmits light between the atomic comagnetometer and a remote location. A method of sensing orientation of an instrument assembly in a subterranean well can include incorporating an atomic comagnetometer into the instrument assembly, and installing the instrument assembly in the well.

20 Claims, 3 Drawing Sheets

DOWNHOLE ORIENTATION SENSING WITH NUCLEAR SPIN GYROSCOPE

BACKGROUND

This disclosure relates generally to equipment utilized and operations performed in conjunction with a subterranean well and, in an example described below, more particularly provides for downhole orientation sensing with a nuclear spin gyroscope.

It is frequently desirable to be able to sense the orientation of well tools, instruments, etc. in a well. For example, in some logging operations, sensitive tiltmeters and microseismic sensors are used, and the orientation of these sensors in a well need to be known, in order to relate sensed parameters to their positions in space relative to the well.

Various mechanical and optical gyroscopes, gyrocompasses, etc. are known in the art, but each of these suffers from one or more deficiencies. These deficiencies can include mechanical complexity, the use of rapidly spinning components which can interfere with sensitive tiltmeters and microseismic instruments, lack of ability to find a true north direction on its own, large dimensions, low acceptable operating temperature, inability to operate effectively in a ferrous casing, etc.

Therefore, it will be appreciated that improvements are needed in the art of downhole orientation sensing. These improvements would be useful in logging and other operations in which the orientation of downhole instruments, well tools, etc. is desired.

SUMMARY

In the disclosure below, systems and methods are provided which bring improvements to the art of downhole orientation sensing. One example is described below in which a nuclear spin gyroscope is used for downhole orientation sensing. Another example is described below in which a downhole atomic comagnetometer is optically pumped and interrogated from a remote location.

In one aspect, a downhole orientation sensing system for use in conjunction with a subterranean well is provided by this disclosure. The sensing system can comprise a downhole instrument assembly positioned in the well. The instrument assembly includes an atomic comagnetometer. One or more optical waveguides transmit light between the atomic comagnetometer and a remote location.

In another aspect, a method of sensing orientation of an instrument assembly in a subterranean well is provided by this disclosure. The method can comprise incorporating an atomic comagnetometer into the instrument assembly, and installing the instrument assembly in the well.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
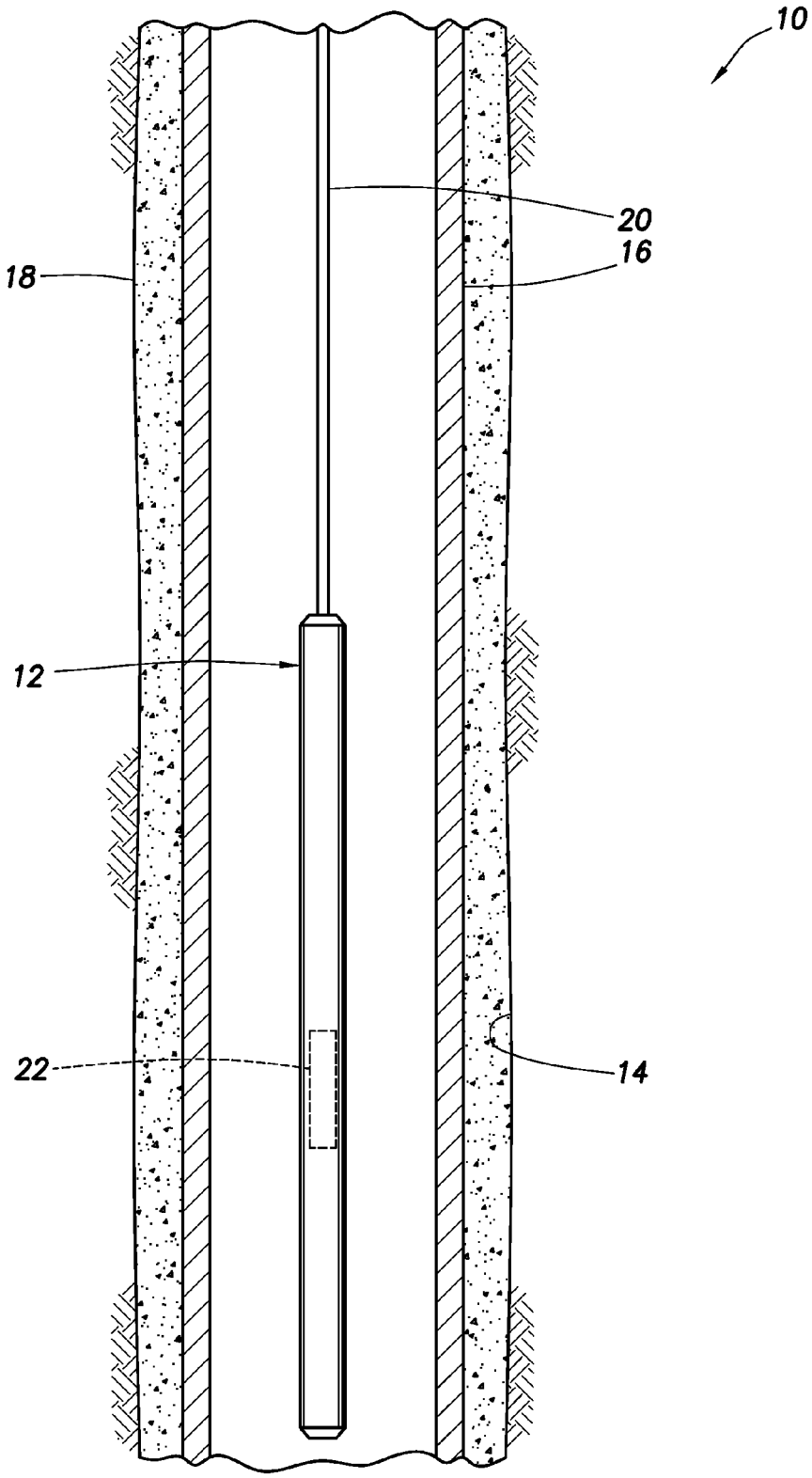
FIG. 1 is a schematic partially cross-sectional view of a downhole orientation sensing system embodying principles of the present disclosure.

Representatively illustrated in FIG. 1 is a downhole orientation sensing system 10 and associated method which embody principles of this disclosure. As depicted in FIG. 1, a well logging operation is being performed, in which an instrument assembly 12 is conveyed into a wellbore 14 lined with casing 16 and cement 18.

The instrument assembly 12 may include any number or combination of instruments (such as, microseismic sensors, tiltmeters, etc.). The instruments may include logging instruments and/or instruments not typically referred to as "logging" instruments by those skilled in the art. The instrument assembly 12 may also include other types of well tools, components, etc.

In the example of FIG. 1, the instrument assembly 12 is conveyed through the wellbore 14 on a cable 20. The cable 20 may be of the type known to those skilled in the art as a wireline, logging cable, etc. The cable 20 may include any number, type and combination of lines (such as electrical, hydraulic and optical lines, etc.).

Note that the cable 20 is only one possible means of conveying the instrument assembly 12 through the wellbore 14. In other examples, a tubular string (such as a production tubing or coiled tubing string, etc.), self-propulsion or other means may be used for conveying the instrument assembly 12. The cable 20 could be incorporated into a sidewall of the tubular string, or the cable could be internal or external to the tubular string. In further examples, the instrument assembly 12 could be incorporated into another well tool assembly, which is conveyed by other means.

Thus, it should be clearly understood that the sensing system 10 as representatively depicted in FIG. 1 is only one of a wide variety of possible implementations of the principles described in this disclosure. Those principles are not limited at all to any of the details of the sensing system 10 as described herein and illustrated in the drawings.

In one unique feature of the sensing system 10, the instrument assembly 12 includes at least one atomic comagnetometer 22 for sensing a downhole orientation of the instrument assembly. The atomic comagnetometer 22 is sensitive to a rate of mechanical rotation about a particular axis and, in combination with other components described more fully below, is part of a nuclear spin gyroscope.

Figure 2:
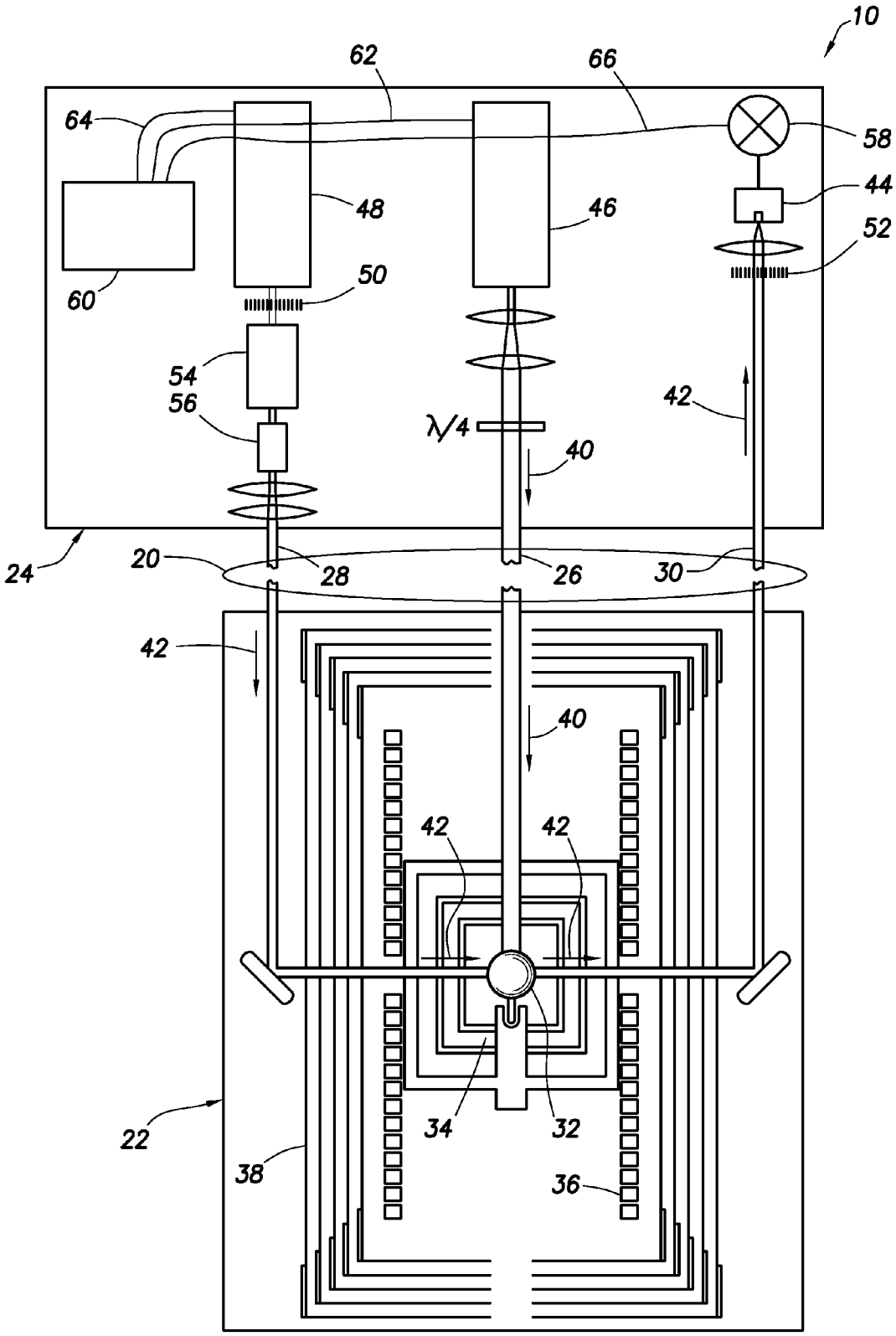
FIG. 2 is an enlarged scale schematic view of a control system and atomic comagnetometer which may be used in the sensing system of FIG. 1.

Referring additionally now to FIG. 2, an enlarged scale schematic view of the atomic comagnetometer 22 and a control system 24 is representatively illustrated, apart from the remainder of the sensing system 10. In this view, it may be seen that the control system 24 is preferably remotely positioned relative to the comagnetometer 22. The control system 24 could be positioned at a surface location, a subsea location, a rig location, or at any other remote location.

In the example of FIG. 2, the control system 24 is connected to the comagnetometer 22 via the cable 20. The cable 20 includes optical waveguides 26, 28, 30 (such as optical fibers, optical ribbons, etc.) for transmitting light between the control system 24 and the comagnetometer 22.

As depicted in FIG. 2, the comagnetometer 22 includes a cell 32, a hot air chamber 34 surrounding the cell, field coils 36 and magnetic shields 38 enclosing the other components. The cell 32 is preferably a spherical glass container with an alkali metal vapor, a noble gas and nitrogen therein.

In one example, the alkali metal may comprise potassium or rubidium, and the noble gas may comprise helium or neon.

However, other alkali metals and noble gases may be used in keeping with principles of this disclosure.

A pump beam 40 transmitted by the optical waveguide 26 enters the cell 30 and polarizes the alkali metal atoms. The polarization is transferred to the noble gas nuclei by spin-exchange collisions.

A probe beam 42 transmitted to the cell 32 by the optical waveguide 28 passes through the cell perpendicular to the pump beam 40. The probe beam 42 is transmitted from the cell 32 to a photodetector 44 by the optical waveguide 30.

Analysis of the probe beam 42 characteristics provides an indication of the direction of the alkali metal polarization (and, thus, the strongly coupled nuclear polarization of the noble gas). The relationships among the electron polarization of the alkali metal atoms, the nuclear polarization of the noble gas atoms, the magnetic fields, and the mechanical rotation of the comagnetometer 22 are described by a system of coupled Bloch equations. The equations have been solved to obtain an equation for a compensating magnetic field (automatically generated in the comagnetometer, and which exactly cancels other magnetic fields), and a gyroscope output signal that is proportional to the rate of mechanical rotation about an axis and independent of magnetic fields.

A similar atomic comagnetometer, and its use in a nuclear spin gyroscope, are described by T. W. Kornack, et al., "Nuclear spin gyroscope based on an atomic co-magnetometer," NASA Tech Briefs LEW-17942-1 (Jan. 1, 2008). Since the details of the comagnetometer 22 and its operation are well known to those skilled in the art, it will not be described further herein.

As described above, the comagnetometer 22 is incorporated in an instrument assembly 12 which is positioned in a well. At a location remote from the comagnetometer 22, the control system 24 includes a pump laser 46 which generates the pump beam 40. Another probe laser 48 generates the probe beam 42.

Other components which may comprise the control system 24 include polarizers 50, 52, a Faraday modulator 54, a Pockel cell 56, a lock-in amplifier 58 and electronic circuitry 60 (such as, a power supply, analog circuit components, one or more electronic processors, telemetry circuit components, memory, software for controlling operation of the lasers 46, 48, software for receiving and analyzing the output of the amplifier 58, etc.). The electronic circuitry 60 may be connected to the lasers 46, 48 and amplifier 58 via lines 62, 64, 66.

Note that it is not necessary for all of the components depicted in FIG. 2 to be included in the control system 24, and other components could be provided, in keeping with the principles of this disclosure. For example, the photodetector 44, polarizer 52 and amplifier 58 could be positioned downhole (e.g., as part of the instrument assembly 12, etc.), in which case the cable 20 may not include the optical waveguide 30, but instead could include the line 66 (i.e., extending from the downhole instrument assembly 12 to the control system 24).

In another example, the probe laser 48 and associated polarizer 50, Faraday modulator 54 and Pockel cell 56 could be positioned downhole. Preferably, at least the pump laser 46 is included in the control system 24 at the remote location, since it is desirably a high power diode laser, which may be difficult to maintain within an acceptable operating temperature range in a relatively high temperature downhole environment, although a cooler (such as a thermo-electric cooler) could be used to cool the pump laser and/or the probe laser 48 downhole, if desired.

The pump laser 46 preferably generates the pump beam 40 at wavelengths of 770 nm and 770.5 nm or 794.68 nm and 795.28 nm for respective potassium and rubidium alkali metals. However, the attenuation of optical power in an optical waveguide is highly dependent on the wavelength of the incident optical source. In the 770 nm to 800 nm range, the Rayleigh scattering loss in an optical fiber is relatively high.

To compensate for Rayleigh scattering loss over perhaps multiple kilometers of the waveguide 26, the pump laser 46 is preferably a relatively high power diode laser. However, with more powerful lasers, it is desirable to design around additional linear scattering effects due to high optical power densities including, for example, elastic and inelastic types (e.g., Raman and Brillouin), and non-linear scattering effects (via parametric conversion).

In particular, Raman and Brillouin scattering effects are due to the "glass-light" (material-electromagnetic field) interaction and become significant at about 100 mW in singlemode optical fiber. Certain multimode optical fibers with larger core diameters and higher solid angle acceptance cones (higher numerical aperture) allow for reduction in optical power density, in order to operate below Raman and Brillouin scattering power density thresholds.

In one example, a reduced scattering step index optical fiber may be used for the waveguide 26. Step index fibers use pure silica (or low doping concentrations) for the core material.

Such step index fibers are less lossy as compared with parabolically doped graded index "higher bandwidth" fiber which typically uses germanium to increase the refractive index of the core. Germanium is an impurity in the glass and will amplify backscatter effects.

Because a greater portion of the optical signal will be reflected back along a graded index fiber, the optical power transmitted and, thus, the optical power available at the downhole end of the fiber will be reduced. A fiber with less attenuation will permit use of a lower power optical source.

In another example, a double frequency optical source may be used, and second harmonic generation (frequency doubling) may be performed at the downhole instrument assembly 12. Attenuation in an optical fiber is relatively low in the range of 1540 nm to 1600 nm.

Second harmonic generation is a nonlinear optical process, in which photons interacting with a nonlinear material are effectively "combined" to form new photons with twice the energy and, therefore, twice the frequency and half the wavelength of the initial photons. It is a special utilization of sum frequency generation.

By using an optical source wavelength which is twice that needed, and performing optical frequency doubling at the downhole instrument assembly 12, optical signal loss over a long transmission length can be substantially reduced. This will permit use of lower power optical sources.

In a preferred example, the beams 40, 42 are transmitted from lasers 46, 48 located at the surface to the downhole comagnetometer 22, and the beam 42 is transmitted back to the surface for detection by the photodetector 44. Active (electrically dissipative) electronics are minimized or eliminated downhole.

The optical waveguides 26, 28, 30 extending between the surface and the downhole comagnetometer 22 may be optical fibers, whether singlemode, multimode, dual-mode or a combination thereof. Thus, the cell 32 is both pumped and interrogated from a remote location.

Benefits obtained from these configurations (as compared to prior mechanical and fiber optic gyroscopes, gyrocompasses, etc.) include 1) small dimensioned downhole component package (e.g., less than 5 cm diameter), 2) downhole operating temperature of at least 150 degrees C., 3) minimized moving parts downhole (which could otherwise interfere with tiltmeter and microseismic sensors), and 4) the comagnetometer 22 can automatically orient relative to a true north direction.

Figure 3:
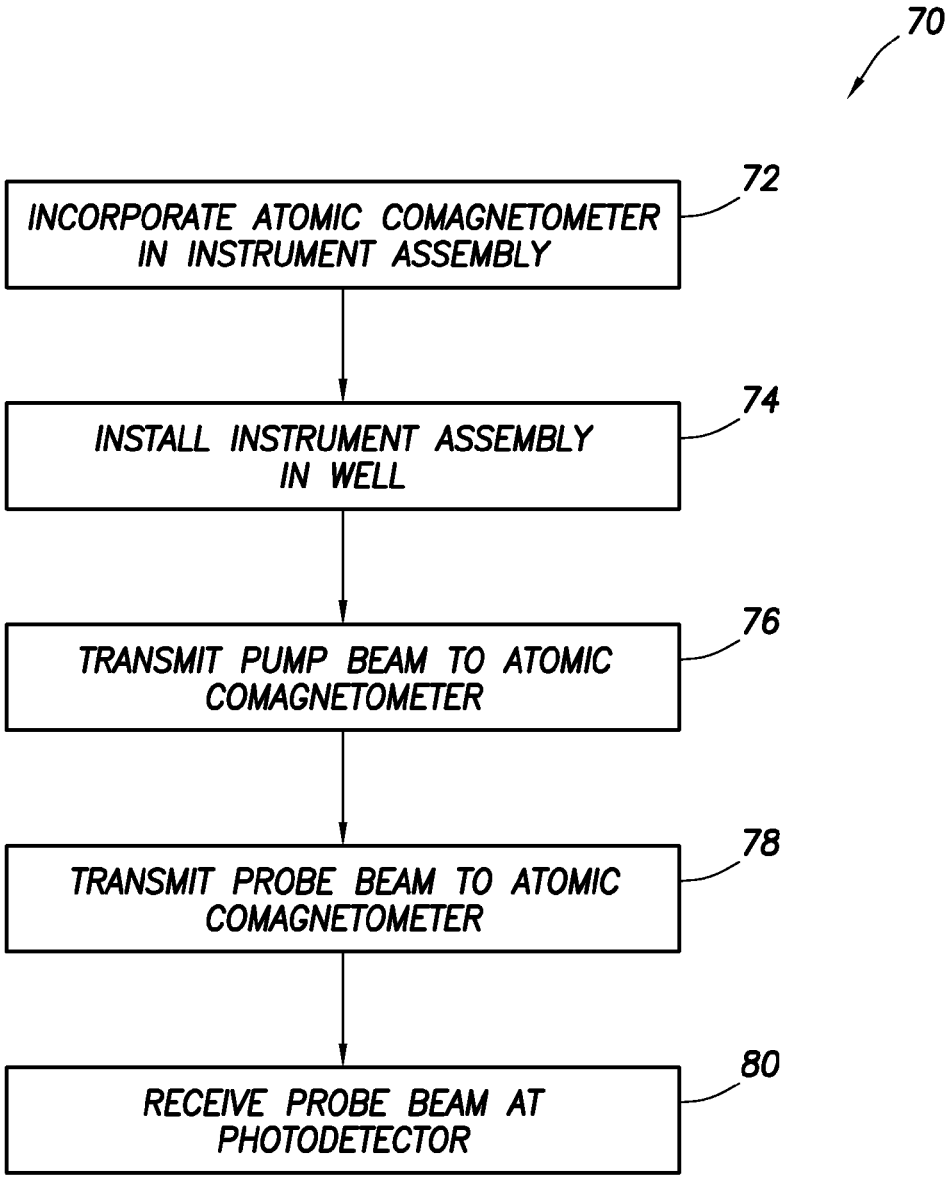
FIG. 3 is a schematic flowchart of an orientation sensing method embodying principles of this disclosure.

Referring additionally now to FIG. 3, a schematic flowchart of an orientation sensing method 70 is representatively illustrated. The method 70 may be used with the sensing system 10 described above, or the method may be used with various different sensing systems.

In an initial step 72, the atomic comagnetometer 22 is incorporated in the instrument assembly 12. As described above, the instrument assembly 12 includes at least the comagnetometer 22, and can include various other instruments, well tools, etc.

In a subsequent step 74, the instrument assembly 12 is installed in the well. This step 74 may comprise conveying the instrument assembly 12 via the cable 20, a tubular string or any other conveying means.

In a step 76, the pump beam 40 is transmitted from the pump laser 46 to the cell 32 of the comagnetometer 22. This polarizes the alkali metal electrons and, via spin-exchange, causes nuclear polarization of the noble gas in the cell 32.

In a step 78, the probe beam 42 is transmitted from the probe laser 48 and through the cell 32. The probe beam 42 is linearly polarized.

In step 80, the probe beam 42 is received at the photodetector 44. By analyzing characteristics of the received probe beam 42, the rotation of the instrument assembly 12 can be determined.

It may now be fully appreciated that the sensing system 10 and method 70 provide advancements to the art of orientation sensing in a subterranean well. Examples described above provide for accurate downhole orientation sensing without use of rapidly moving parts or temperature-sensitive components downhole.

The above disclosure provides a downhole orientation sensing system 10 for use in conjunction with a subterranean well. The sensing system 10 can include a downhole instrument assembly 12 positioned in the well, with the instrument assembly including an atomic comagnetometer 22. One or more optical waveguides 26, 28, 30 transmit light between the atomic comagnetometer 22 and a remote location.

The remote location may comprise at least one of a surface location, a rig location and a subsea location.

The sensing system 10 can include a pump laser 46 which generates a pump beam 40. The pump beam 40 may be transmitted via the optical waveguide 26 from the remote location to the atomic comagnetometer 22.

The sensing system 10 can include a probe laser 48 which generates a probe beam 42. The probe beam 42 may be transmitted via the optical waveguide 28 from the remote location to the atomic comagnetometer 22.

The sensing system 10 can include a photodetector 44 which detects the probe beam 42. The probe beam 42 may be transmitted via the optical waveguide 30 from the atomic comagnetometer 22 to the remote location.

The sensing system 10 may include a surface control system 24 positioned at the remote location. The control system 24 can include a pump laser 46 optically connected to the atomic comagnetometer 22 via the optical waveguide 26.

The control system 24 may also include a probe laser 48 optically connected to the atomic comagnetometer 22 via the optical waveguide 28.

The control system 24 may also include a photodetector 44 optically connected to the atomic comagnetometer 22 via the optical waveguide 30.

The control system 24 may also include electronic circuitry 60 connected to each of the probe laser 48, pump laser 46 and photodetector 44.

An optical signal received from the atomic comagnetometer 22 varies in relation to an orientation of the atomic comagnetometer 22 in the well.

Also described by the above disclosure is a method 70 of sensing orientation of an instrument assembly 12 in a subterranean well. The method 70 includes incorporating an atomic comagnetometer 22 into the instrument assembly 12, and installing the instrument assembly in the well.

The method 70 may also include receiving at a surface location an indication of orientation of the instrument assembly 12 in the well. At least one optical waveguide 26, 28, 30 may extend between the surface location and the instrument assembly 12 in the well.

The method 70 may include transmitting a pump beam 40 via the optical waveguide 26 from the surface location to the atomic comagnetometer 22 in the well.

The method 70 may include transmitting a probe beam 42 via the optical waveguide 28 from the surface location to the atomic comagnetometer 22 in the well.

The method 70 may include transmitting the probe beam 42 via the optical waveguide 30 from the atomic comagnetometer 22 to the surface location.

The method 70 may include, after the instrument assembly 12 installing step, transmitting an indication of orientation of the instrument assembly to a control system 24 at a remote location.

The control system 24 can include a pump laser 46 optically connected to the atomic comagnetometer 22 via the optical waveguide 26.

The control system 24 can include a probe laser 48 optically connected to the atomic comagnetometer 22 via the optical waveguide 28.

The control system 24 can include a photodetector 44 optically connected to the atomic comagnetometer 22 via the optical waveguide 30.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A downhole orientation sensing system for use in conjunction with a subterranean well, the sensing system comprising:

a downhole instrument assembly positioned in the well, the instrument assembly including an atomic comagnetometer; and at least one optical waveguide which transmits light between the atomic comagnetometer and a remote location.

2. The sensing system of claim 1, wherein the remote location comprises at least one of a surface location, a rig location and a subsea location.

3. The sensing system of claim 1, further comprising a pump laser which generates a pump beam, the pump beam being transmitted via the at least one optical waveguide from the remote location to the atomic comagnetometer.

4. The sensing system of claim 3, further comprising a probe laser which generates a probe beam, the probe beam being transmitted via the at least one optical waveguide from the remote location to the atomic comagnetometer.

5. The sensing system of claim 4, further comprising a photodetector which detects the probe beam, the probe beam being transmitted via the at least one optical waveguide from the atomic comagnetometer to the remote location.

6. The sensing system of claim 1, further comprising a surface control system positioned at the remote location, the control system including a pump laser optically connected to the atomic comagnetometer via the at least one optical waveguide.

7. The sensing system of claim 6, wherein the control system further includes a probe laser optically connected to the atomic comagnetometer via the at least one optical waveguide.

8. The sensing system of claim 7, wherein the control system further includes a photodetector optically connected to the atomic comagnetometer via the at least one optical waveguide.

9. The sensing system of claim 8, wherein the control system further includes electronic circuitry connected to each of the probe laser, pump laser and photodetector.

10. The sensing system of claim 1, wherein an optical signal received from the atomic comagnetometer varies in relation to an orientation of the atomic comagnetometer in the well.

11. A method of sensing orientation of an instrument assembly in a subterranean well, the method comprising:

incorporating an atomic comagnetometer into the instrument assembly; and installing the instrument assembly in the well.

12. The method of claim 11, further comprising receiving at a surface location an indication of orientation of the instrument assembly in the well.

13. The method of claim 12, wherein at least one optical waveguide extends between the surface location and the instrument assembly in the well.

14. The method of claim 13, further comprising transmitting a pump beam via the at least one optical waveguide from the surface location to the atomic comagnetometer in the well.

15. The method of claim 13, further comprising transmitting a probe beam via the at least one optical waveguide from the surface location to the atomic comagnetometer in the well.

16. The method of claim 15, further comprising transmitting the probe beam via the at least one optical waveguide from the atomic comagnetometer to the surface location.

17. The method of claim 11, further comprising, after the instrument assembly installing step, transmitting an indication of orientation of the instrument assembly to a control system at a remote location.

18. The method of claim 17, wherein the control system comprises a pump laser optically connected to the atomic comagnetometer via at least one optical waveguide.

19. The method of claim 18, wherein the control system further comprises a probe laser optically connected to the atomic comagnetometer via the at least one optical waveguide.

20. The method of claim 19, wherein the control system further includes a photodetector optically connected to the atomic comagnetometer via the at least one optical waveguide.

* * * * *